US007168383B2

(12) United States Patent
Saito

(10) Patent No.: US 7,168,383 B2
(45) Date of Patent: Jan. 30, 2007

(54) STEERING APPARATUS FOR SHIP PROPELLER

(76) Inventor: Mitsuo Saito, c/o Showa Corporation, 112-1, Hagadai, Hagamachi, Haga-gun, Tochigi (JP)

( * ) Notice: Subject to any disclaimer, the term of this patent is extended or adjusted under 35 U.S.C. 154(b) by 13 days.

(21) Appl. No.: 11/082,290

(22) Filed: Mar. 17, 2005

(65) Prior Publication Data

US 2006/0063441 A1 Mar. 23, 2006

(30) Foreign Application Priority Data

Sep. 22, 2004 (JP) ..... 2004-276030

(51) Int. Cl.
*B63H 25/04* (2006.01)

(52) U.S. Cl. ..... 114/144 R; 440/58

(58) Field of Classification Search ..... 440/53, 440/58, 61 S, 62, 63; 114/144 A, 144 R
See application file for complete search history.

(56) References Cited

U.S. PATENT DOCUMENTS 3,774,568 A * 11/1973 Borst et al. ..... 114/144 R
4,735,165 A * 4/1988 Baba et al. ..... 114/144 R
4,993,976 A 2/1991 Kabuto ..... 440/53
5,357,889 A 10/1994 Wood ..... 114/144 E
5,427,555 A * 6/1995 Merten ..... 440/62
6,892,662 B2 * 5/2005 Watanabe et al. ..... 114/144 R

OTHER PUBLICATIONS

Japanese Patent Application Laid-Open No. HEI 5-221385.

* cited by examiner

*Primary Examiner*—Lars A. Olson
(74) *Attorney, Agent, or Firm*—Orum & Roth, LLC

(57) ABSTRACT

In a steering apparatus for a ship propeller in which a steering handle is provided within a ship body, a propelling unit is fixed to a steering shaft rotatably supported to an attaching bracket fixed to the ship body. A steering cable connected to the steering handle is coupled to a steering arm fixed to the steering shaft. A motor-driven steering assist apparatus for assisting a steering force applied to the steering handle by a driver on the basis of a torque generated by the electric motor is interposed between the steering handle and the steering cable.

4 Claims, 6 Drawing Sheets

STEERING APPARATUS FOR SHIP PROPELLER

BACKGROUND OF THE INVENTION

1. Field of the Invention

The present invention relates to a steering apparatus for a ship propeller.

2. Description of the Related Art

In a steering apparatus for a ship propeller, as described in Japanese Patent Application Laid-open No. 5-221385 (patent document 1), there is a steering apparatus for a ship propeller structured such that a steering handle is provided within a ship body. A propelling unit is fixed to a steering shaft rotatably supported to an attaching bracket fixed to the ship body, and a steering cable connected to the steering handle is coupled to a steering arm fixed to the steering shaft, in which a hydraulic cylinder unit is connected to the steering arm. A working fluid pressure fed by a hydraulic pump driven by an electric motor is supplied to the hydraulic cylinder, thereby assisting steering force applied to the steering handle by a driver.

In the steering apparatus for the ship propeller described in the patent document 1, it is necessary that the hydraulic cylinder unit is provided together with the electric motor and the hydraulic pump near the propelling unit. Accordingly, a large space is required, and a hydraulic circuit is also required in addition to a feeding circuit, which results in a complicated structure. Further, since a pressure receiving area is different between right and left sides of the hydraulic cylinder, it is necessary to correct the rotational speed of the electric motor when turning to the right and the left.

SUMMARY OF THE INVENTION

An object of the present invention is to effectively assist the steering force of a driver on the basis of a structure which is compact and requires a small space, in a steering apparatus for a ship propeller.

In accordance with the present invention, there is provided a steering apparatus for a ship propeller in which a steering handle is provided within a ship body, a propelling unit is fixed to a steering shaft rotatably supported to an attaching bracket fixed to the ship body, and a steering cable connected to the steering handle is coupled to a steering arm fixed to the steering shaft. A motor-driven steering assist apparatus for assisting a steering force applied to the steering handle by a driver on the basis of a torque generated by the electric motor is interposed between the steering handle and the steering cable.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings.

DESCRIPTION OF THE PREFERRED EMBODIMENTS

Figure 1:
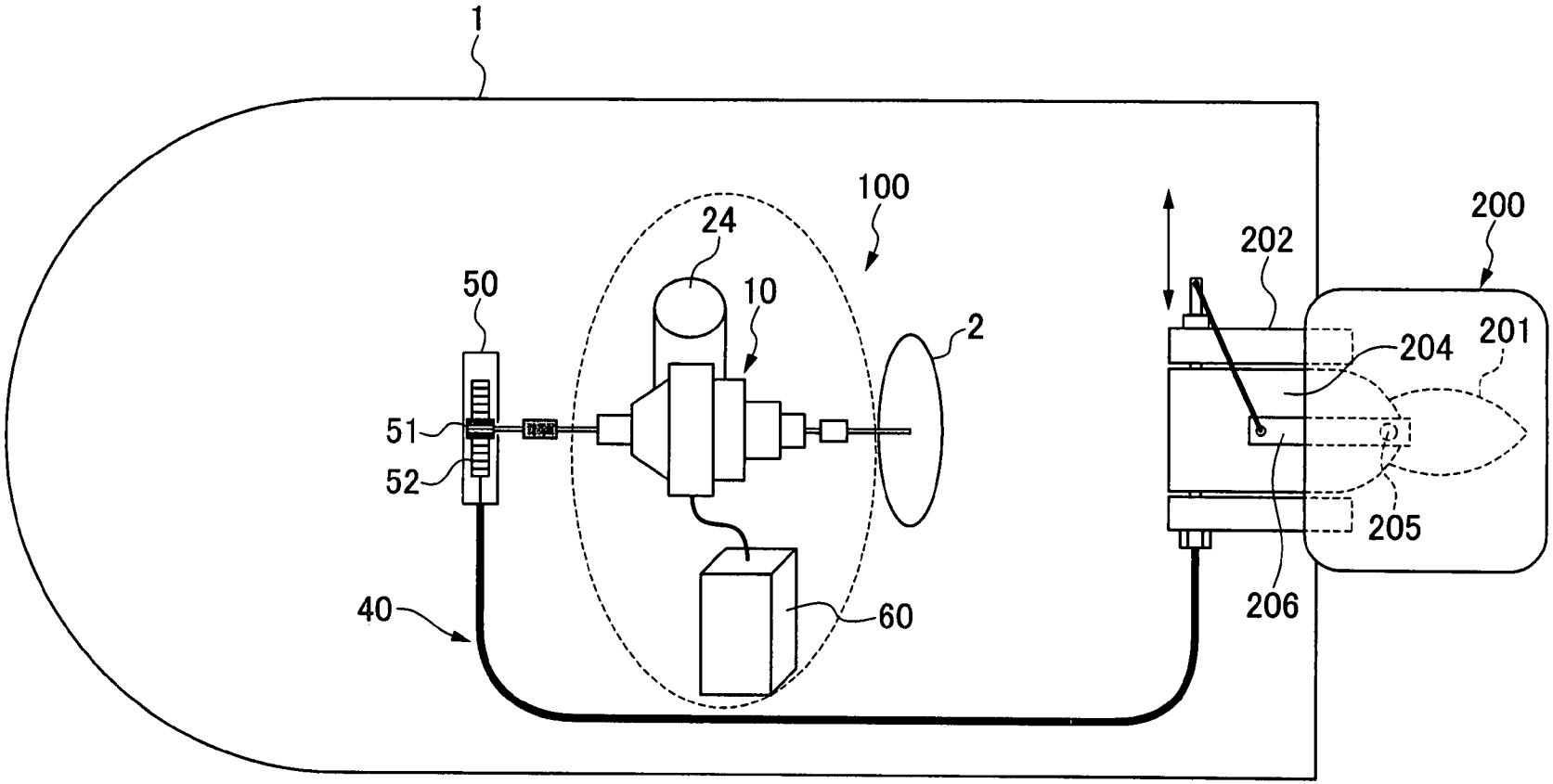
FIG. 1 is a plan view showing a ship to which a steering apparatus for a ship propeller is applied.

A steering apparatus 100 is structured such that a steering handle 2 is provided within a ship body 1. Steering force applied to the steering handle 2 by a driver is transmitted to a propelling unit 201 of an outboard motor 200 via a motor-driven steering assist apparatus 10 and a steering cable 40.

Figure 2:
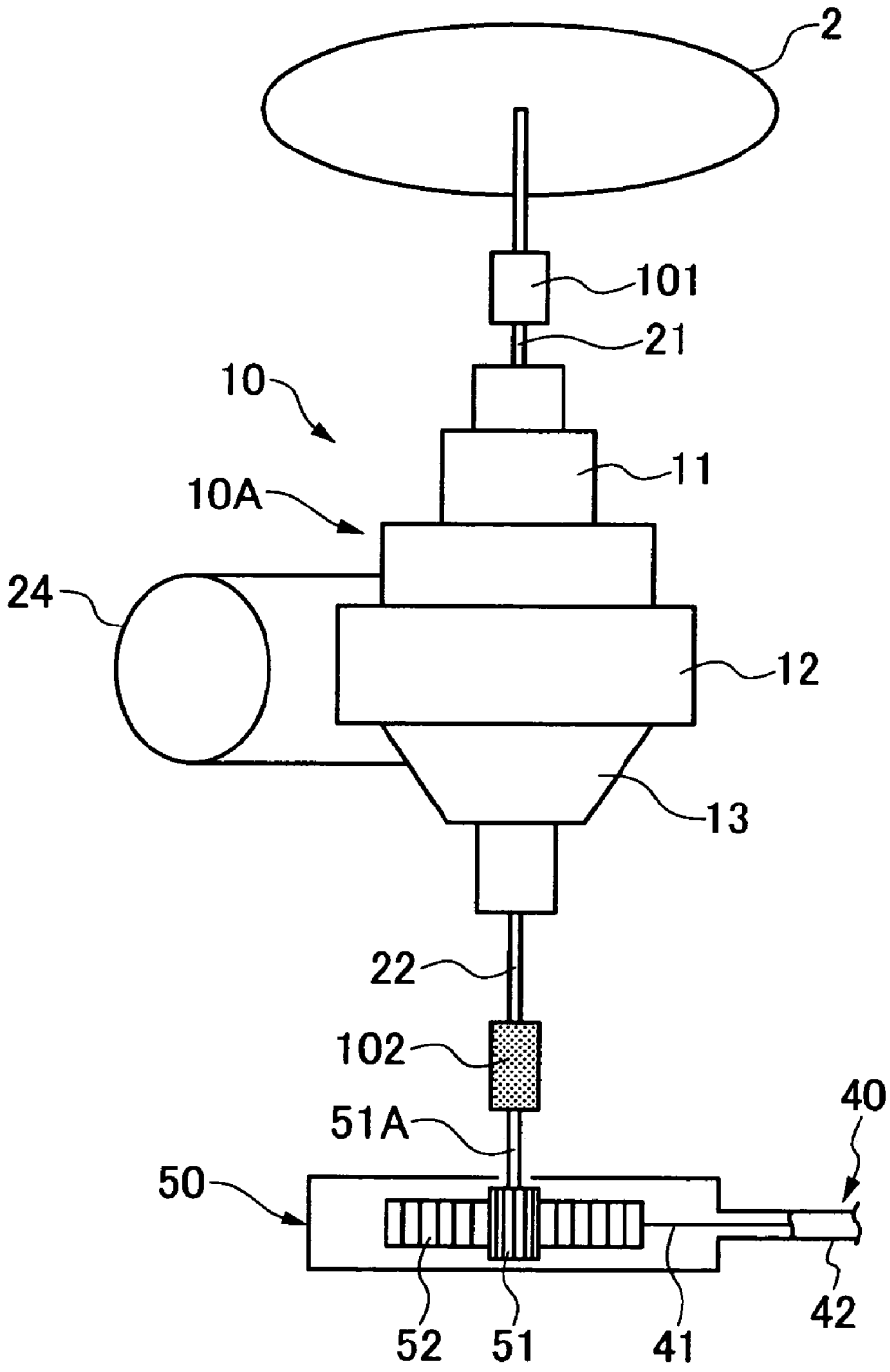
FIG. 2 is a plan view showing a connection portion between a motor-driven steering assist apparatus and a steering cable.

The steering apparatus 100 is structured, as shown in FIGS. 1 and 2, such that the motor-driven steering apparatus 10 is placed within the ship body 1. The steering handle 2 is connected to an input shaft 21 of the motor-driven steering assist apparatus 10 via a connector 101. A pinion 51A connected to an output shaft 22 of the motor-driven steering assist apparatus 10 via a connector 102 is inserted to a gear box 50 fixed to an inner side of the ship body 1, and a rack bar 52 engaging with a pinion 51 provided in an insertion end of the pinion shaft 51A is supported within the gear box 50 so as to freely reciprocate.

Figure 3:
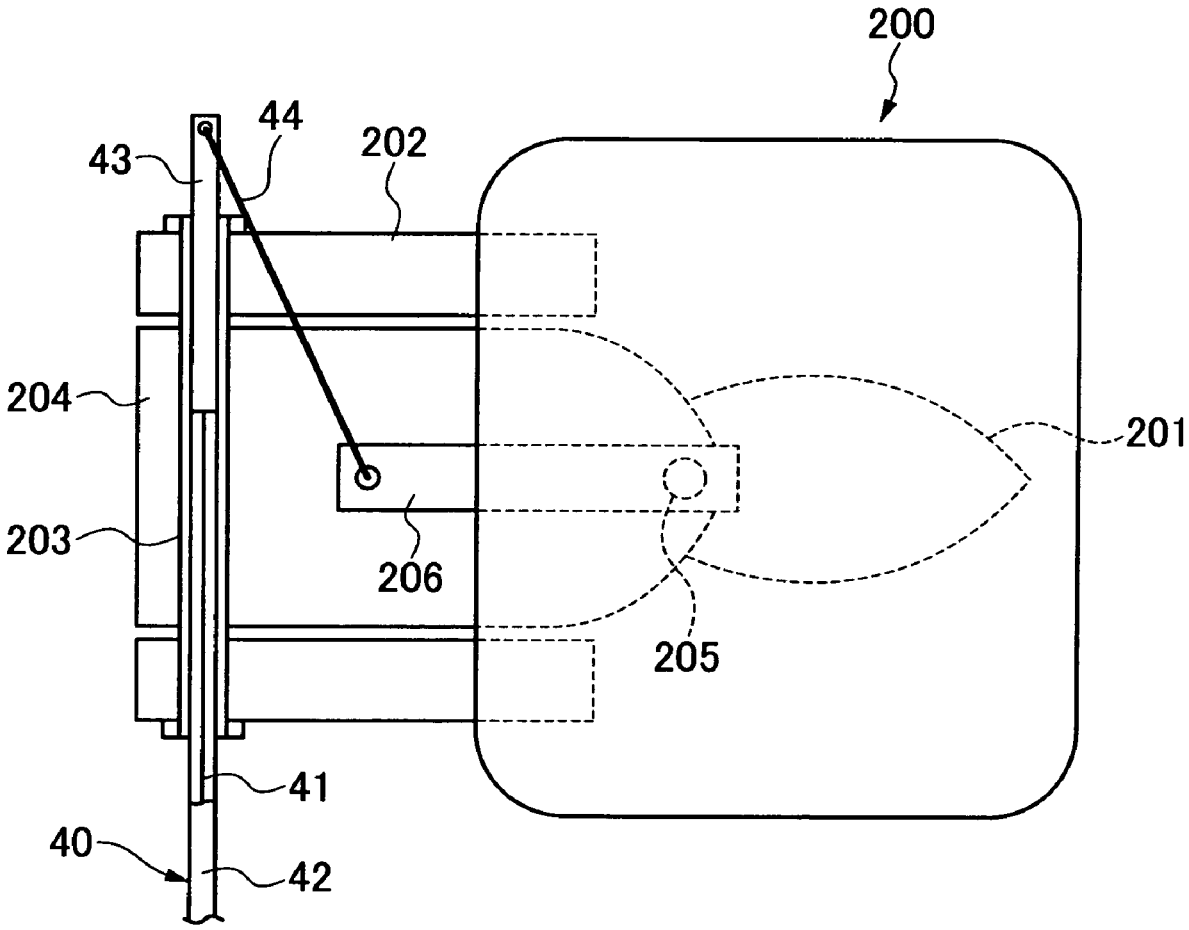
FIG. 3 is a plan view showing a connection portion between a steering arm and the steering cable.

The outboard motor 200 is structured, as shown in FIGS. 1 and 3, such that a swivel bracket 204 is supported to a cramp bracket 202 fixed to a stern board of the ship body 1 via a tilt tube 203 so as to freely tilt. The propelling unit 201 is fixed to a steering shaft 205 rotatably supported to the swivel bracket 204.

In this case, the steering cable 40 is constituted by a known push-pull cable having a high load transfer performance in both push and pull directions. An inner cable 41 is inserted into an outer tube 42, and is structured such that one end portion of the outer tube 42 is fixed to the gear box 50 and the other end portion of the outer tube 42 is fixed to the tilt tube 203 provided in the cramp bracket 202. One end portion of the inner cable 41 is introduced to the gear box 50 so as to be connected to the rack bar 52, and the other end portion of the inner cable 41 is connected to an insertion end of a slide rod 43 slidably inserted to the tilt tube 203, and a protruding end of the slide rod 43 protruding to an outer side from the tilt tube 203 is connected to a steering arm 206 via a joint rod 44. The steering arm 206 is integrally formed in the steering shaft 205.

Accordingly, the motor-driven steering assist apparatus 10 assists the steering force which the driver applies to the steering handle 2 on the basis of torque generated by the electric motor 24. Therefore, the steering force in any one of the right and left sides applied by the driver is transmitted to the inner cable 41 of the steering cable 40 via the pinion 51 and the rack bar 52, being assisted by the motor-driven steering assist apparatus 10. The steering force transmitted to the inner cable 41 of the steering cable 40 is transmitted to the steering arm 206 of the outboard motor 200 via the slide rod 43 and the joint rod 44, thereby steering the propelling unit 201 via the steering shaft 205.

Figure 4:
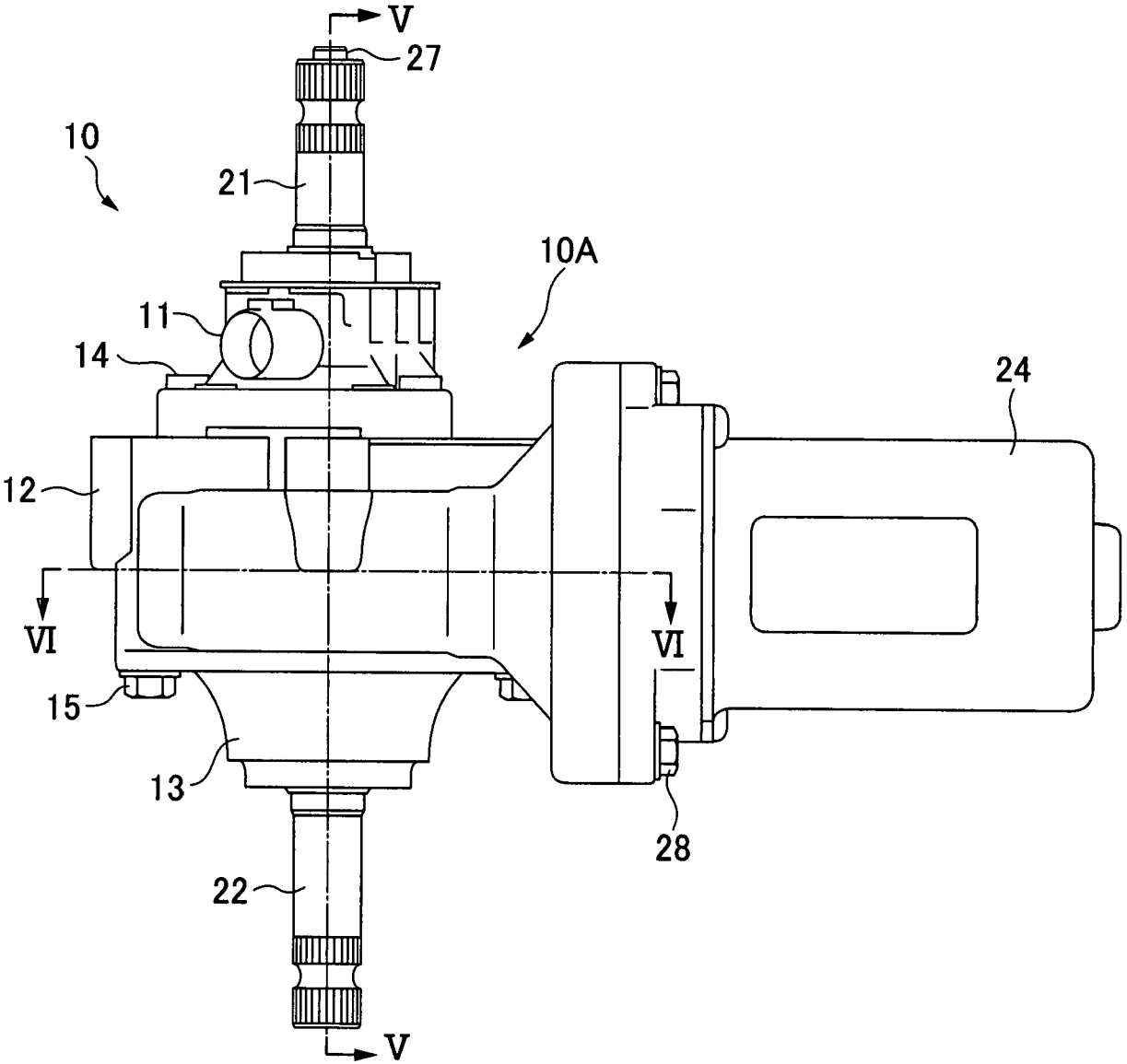
FIG. 4 is a front elevational view showing the motor-driven steering assist apparatus.
Figure 5:
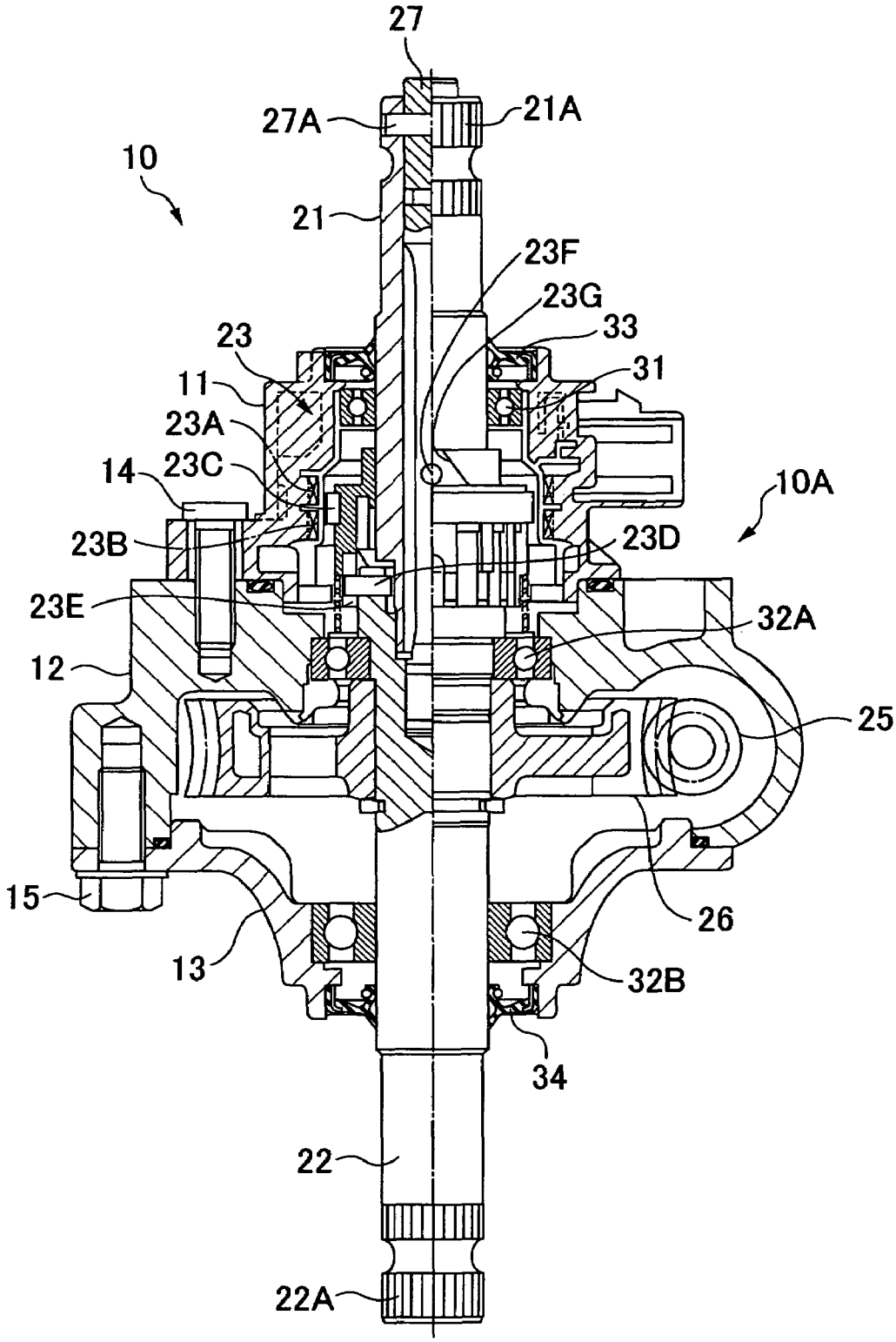
FIG. 5 is a cross sectional view along a line V—V in FIG. 4.
Figure 6:
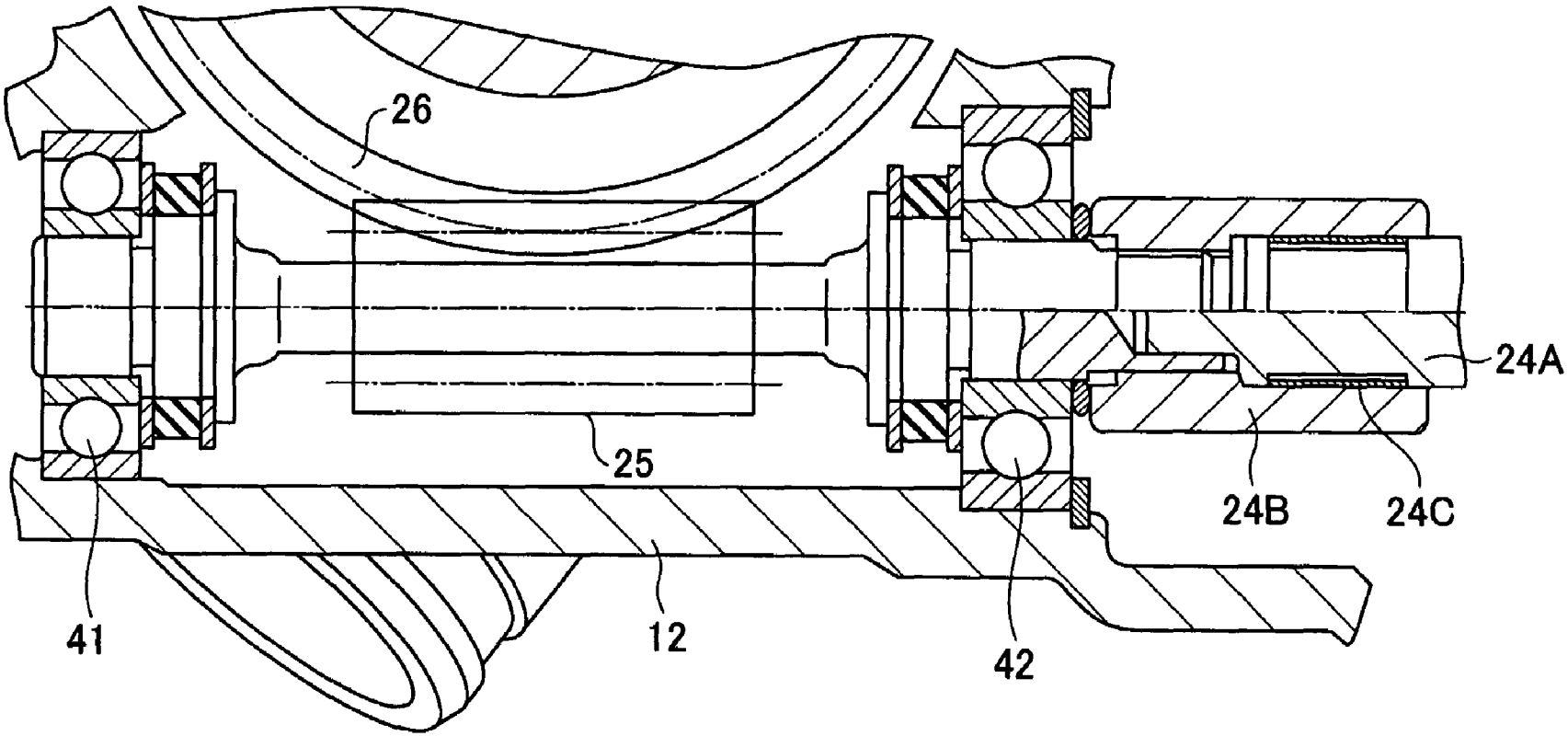
FIG. 6 is a cross sectional view along a line VI—VI in FIG. 4.

The motor-driven steering assist apparatus 10 structure includes a single unit body 10A covered by first to third housings 11 to 13, as shown in FIGS. 4 to 6. The unit body 10A has an input shaft 21, an output shaft 22, a torque sensor 23, an electric motor 24, a worm gear 25 and a worm wheel 26 built-in.

The motor-driven steering assist apparatus 10 is structured such that an upper end portion of the input shaft 21 to which the steering handle 2 is connected by the connector 101 is supported to the first housing 11 by a bearing 31 (FIG. 5). Upper and lower end portions of the output shaft 22 to which the pinion 51A is connected by the connector 102 are supported to the second housing 12, and the third housing 13 by upper and lower bearings 32A and 32B (FIG. 5). The input shaft 21 is provided with a serration 21A for connecting to the connector 101 in an upper end outer peripheral portion, and the output shaft 22 is provided with a serration 22A for connecting to the connector 102 in a lower end outer peripheral portion. A torsion bar 27 is inserted in a hollow portion of the input shaft 21. One end of the torsion bar 27 is connected to the input shaft 21 by a connecting pin 27A, and the other end of the torsion bar 27 is inserted to the hollow portion of the output shaft 22 so as to be coupled by serration.

A torque sensor 23 is provided with two detecting coils 23A and 23B surrounding a cylindrical core 23C engaged with the input shaft 21 and the output shaft 22, in the first housing 11, as shown in FIG. 5. The core 23C is provided with a vertical groove 23E engaging with a guide pin 23D of the output shaft 22 so as to be movable only in an axial direction, and is provided with a spiral groove 23G engaging with a slider pin 23F of the input shaft 21. When a steering torque applied to the steering wheel is applied to the input shaft 21, a relative displacement in a rotation direction is generated between the input shaft 21 and the output shaft 22 on the basis of an elastic torsional deformation of the torsion bar 27. The displacement in the rotation direction of the input shaft 21 and the output shaft 22 displaces the core 23C in an axial direction, and an inductance of the detecting coils 23A and 23B caused by a magnetic change around the detecting coils 23A and 23B due to the displacement of the core 23C is changed. In other words, when the core 23C moves close to the input shaft 21, the inductance of the detecting coil 23A to which the core 23C moves close is increased, and the inductance of the detecting coil 23B from which the core 23C moves apart is reduced, whereby it is possible to detect the steering torque on the basis of the change of the inductance.

The electric motor 24 is attached and supported to the second housing 12 by a mounting bolt 28, and is driven by a controller (not shown) in correspondence to the detected torque of the torque sensor 23. A worm gear 25 is coupled to a rotation shaft 24A of the electric motor 24 by a joint 24B, and the worm wheel 26 engaging with the worm gear 25 is fixed to the output shaft 22. The worm gear 25 is supported at both ends to the second housing 12 by right and left bearings 41 and 42, as shown in FIG. 6. The worm wheel 26 is fixed to the output shaft 22 just below an upper bearing 32A in the output shaft 22, in an inner portion of the second housing 12.

In this case, the joint 24B coupling the rotation shaft 24A of the electric motor 24 and the worm gear 25 is structured such that a torque limiter 24C constituted by an elastic ring is interposed in a fitting gap between both the elements (FIG. 6). The torque limiter 24C maintains coupling of the rotation shaft 24A and the joint 24B under normal torque conditions of the motor-driven steering assist apparatus 10, allows them to slip under abnormal torque conditions, and does not transmit the torque of the electric motor 24 to a side of the joint 24B.

In the motor-driven steering assist apparatus, an integral unit body 10A is structured by the following structures; the upper end portion of the input shaft 21 and the torque sensor 23 are supported to the first housing 11; the upper end portion of the output shaft 22, the electric motor 24, the worm gear 25 and the worm wheel 26 are supported to the second housing 12; the lower end portion of the output shaft 22 is supported to the third housing 13; the first housing 11 and the second housing 12 are coupled by the mounting bolt 14; and the second housing 12 and the third housing 13 are coupled by the mounting bolt 15 (FIG. 5). An oil seal 33 is attached in a sealing manner to an upper opening portion of the bearing 31 in the first housing 11. An oil seal 34 is attached in a sealing manner to a lower opening portion of the bearing 32B in the third housing 13 (FIG. 5).

In this case, the motor-driven steering assist apparatus 10 is additionally provided with a control apparatus (ECU) 60 for driving the electric motor 24, and the control apparatus 60 is placed beside a single unit body 10A. The control apparatus 60 determines a supply power to the electric motor 24 on the basis of an input signal from a torque sensor 23 or the like, and drives the electric motor 24 via an external drive apparatus including a power source on the basis of the determined value.

In accordance with the motor-driven steering assist apparatus 10, the steering torque applied to the steering handle is detected by the torque sensor 23. The ECU 60 drives the electric motor 24 on the basis of the detected torque, and the torque generated by the electric motor 24 is transmitted to the output shaft 22 via a worm gear 25 and a worm wheel 26. Accordingly, the torque generated by the electric motor 24 can be used as an assist force with respect to the steering force which the driver applies to the steering handle 2.

In accordance with the present embodiment, the following operation and effects can be achieved.

(a) Since the motor-driven steering assist apparatus 10 is interposed between the steering handle 2 and the steering cable 40, no extra space is required near the propelling unit 201.

(b) Since only the feeding circuit to the electric motor 24 is provided, the structure is simple without requiring a hydraulic circuit.

(c) Since the motor-driven steering assist apparatus 10 is constituted by the single unit body 10A, the input shaft 21 is connected to the side of the steering handle 2 and the output shaft 22 is connected to the side of the steering cable 40. The motor-driven steering assist apparatus 10 can be easily equipped in the subject ship, and the apparatus can be applied to various ships at a high general-purpose usage.

(d) Since the electric motor 24 assisting the steering force of the driver is driven in correspondence to the detected torque of the torque sensor 23, it is possible to effectively assist the steering force of the driver.

(e) Since the torque sensor 23 is provided in the first housing 11, and the worm wheel 26 and the like are provided in the second housing 12, it is easy to prevent grease from the worm wheel 26 and the like from entering into the side of the torque sensor 23.

(f) Since the upper end portion of the output shaft 22 is supported to the second housing 12, and the lower end portion of the output shaft 22 is supported to the third housing 13, it is possible to secure a distance between the bearing 32A in the upper end portion of the output shaft 22 and the bearing 32B in the lower end portion, and it is possible to stably support the output shaft 22.

(g) Since the motor-driven steering assist apparatus 10 is additionally provided with the control apparatus 60 for driving the electric motor 24, the motor-driven steering assist apparatus 10 and the control apparatus can be easily equipped in the subject ship, and the apparatus can be applied to various ships at a high general-purpose usage.

As heretofore explained, embodiments of the present invention have been described in detail with reference to the drawings. However, the specific configurations of the present invention are not limited to the illustrated embodiments but those having a modification of the design within the range of the presently claimed invention are also included in the present invention.

Although the invention has been illustrated and described with respect to several exemplary embodiments thereof, it should be understood by those skilled in the art that the foregoing and various other changes, omissions and additions may be made to the present invention without departing from the spirit and scope thereof Therefore, the present invention should not be understood as limited to the specific embodiment set out above, but should be understood to include all possible embodiments which can be encompassed within a scope of equivalents thereof with respect to the features set out in the appended claims.

What is claimed is:

1. A steering apparatus for a comprising:

a steering handle provided on a ship body, a propelling unit fixed to a steering shaft rotatably supported to an attaching bracket fixed to the ship body, a steering cable connected to the steering handle coupled to a steering arm fixed to the steering shaft, and a motor-driven steering assist apparatus for assisting steering force applied to the steering handle by a driver on the basis of a torque generated by an electric motor being disposed between the steering handle and the steering cable, wherein the motor-driven steering assist apparatus comprises an input shaft in a side to which the steering handle is connected, an output shaft in a side to which the steering cable is connected, a torque sensor provided between the input shaft and the output shaft, an electric motor driven in correspondence to a detected torque of the torque sensor, a worm gear coupled to a rotating shaft of the electric motor, and a worm wheel coupled to the output shaft and engaging with the worm gear in a single unit body and the single unit body is covered by first to third housings, an upper end portion of the input shaft and the torque sensor are supported to the first housing, an upper end portion of the output shaft, the electric motor, the worm gear and the worm wheel are supported to the second housing, and a lower end portion of the output shaft is supported to the third housing.

2. A steering apparatus for a ship propeller as claimed in claim 1, wherein the motor-driven steering assist apparatus is additionally provided with a control apparatus for driving the electric motor.

3. A motor-driven steering assist apparatus as claimed in claim 2, wherein the output shaft is structured such that an upper end portion is supported by a bearing provided in the second housing, a lower end portion is supported by a bearing provided in the third housing, and the worm wheel is fixed to the output shaft just below the bearing provided in the second housing in the output shaft, in an inner portion of the second housing.

4. A motor-driven steering assist apparatus as claimed in claim 1, wherein the output shaft is structured such that an upper end portion is supported by a bearing provided in the second housing, a lower end portion is supported by a bearing provided in the third housing, and the worm wheel is fixed to the output shaft just below the bearing provided in the second housing in the output shaft, in an inner portion of the second housing.

* * * * *